United States Patent [19]

Berges et al.

[11] 4,141,205

[45] Feb. 27, 1979

[54] STRANDING PROCESS AND APPARATUS

[75] Inventors: Dietrich Berges, Marienheide; Ulrich Saam, Gummersbach; Robert Führer; Bodo Damzog, both of Remscheid, all of Fed. Rep. of Germany

[73] Assignee: Barmag Barmer Maschinenfabrik AG, Remscheid-Lennep, Fed. Rep. of Germany

[21] Appl. No.: 853,446

[22] Filed: Nov. 21, 1977

[30] Foreign Application Priority Data

Nov. 22, 1976 [DE] Fed. Rep. of Germany ..... 2653041

[51] Int. Cl.[2] ..... D07B 3/00; D07B 3/04; D01H 1/10

[52] U.S. Cl. ..... 57/58.32; 57/58.55; 57/64; 57/314

[58] Field of Search ..... 57/58.3–58.38, 57/58.52–58.57, 156, 63, 64

[56] References Cited

U.S. PATENT DOCUMENTS

| | | | |
|---|---|---|---|
| 2,053,645 | 9/1936 | Weaver | 57/58.55 |
| 2,499,245 | 2/1950 | Harmon | 57/58.32 |
| 2,525,230 | 10/1950 | MacCreadie | 57/58.54 X |
| 2,633,692 | 4/1953 | MacCreadie | 57/58.55 UX |
| 3,425,203 | 2/1969 | Schillebeeck | 57/58.38 X |
| 3,456,433 | 7/1969 | Cloostermans-Huwaert | 57/58.34 X |
| 3,726,074 | 4/1973 | Peene | 57/58.34 |
| 3,981,131 | 9/1976 | Hartig et al. | 57/58.54 |
| 3,992,867 | 11/1976 | Hartig et al. | 57/58.54 X |
| 4,002,015 | 1/1977 | Berges et al. | 57/58.38 |

*Primary Examiner*—John Petrakes
*Attorney, Agent, or Firm*—John H. Shurtleff

[57] ABSTRACT

A stranding process for producing a cable made up of multiple groups of plied filaments being fed from linear feed positions located along a common twisting axis, said process including steps wherein at least one of the groups is plied and twisted according to the double-twist principle and all of the groups are then plied and twisted together by the cable-twist principle in a common twisting zone. A specific combination of apparatus is provided to carry out the required plying and stranding steps in a single operation.

4 Claims, 7 Drawing Figures

STRANDING PROCESS AND APPARATUS

Especially useful apparatus for plying and stranding individual wires or filaments by the so-called double-twist or two-for-one twisting principle has been described in the German published patent specification (DOS) No. 2,404,030 which corresponds to U.S. Pat. No. 4,002,015. According to the German published patent specification (DOS) No. 2,406,667, corresponding to U.S. Pat. No. 3,992,867, this double-twist is imparted in such a manner that one rotating balloon envelops each feed package, i.e., so that the plied strands cross and finally meet the twisting axis behind each feed package. An especially preferred high-speed wire twisting machine using the double-twist principle is disclosed in the German published patent specification (DOS) No. 2,407,473, corresponding to U.S. Pat. No. 3,981,131, using specially designed rotors and deflection or guide means to conduct the individual wires forwardly around each feed spool as they are plied together and then backwardly in the desired balloon pattern.

In using these previously described stranding machines, e.g., in a double-twist process for making a wire strand or cable, the strand constructions have been homogeneous in themselves such that each wire has had the same pitch or lay in the finished product, including the same twist length or length of lay, the same twist direction and the same position relative to the center of the resulting strand or cable.

It is further known that wire cables or the like can be produced by using so-called rotary drum cable-twisting machines of the type disclosed for example in U.S. Pat. No. 3,456,433, other variations of such rotary drum machines and their operation being set forth in U.S. Pat. Nos. 3,636,692 and 3,726,074. The use of double drums positioned end-to-end is disclosed in an earlier variation of a rotary drum machine set forth in U.S. Pat. No. 1,870,290, but even here the strand or cable being made exhibits a uniform twist or homogeneous structure due to the synchronized rotation of both drums.

It is an object of the present invention to provide a stranding process and apparatus combining the distinct features of both double-twist stranding machines and cable-twist stranding machines. It is also an object of the invention to provide a stranding process and apparatus capable of producing cable of individual wires or similar filaments consisting of core wires along the central longitudinal axis of the cable and mantle wires wrapped or twisted around the core wires, wherein the core wires and the mantle wires differ in their pitch and twist length.

It has now been found, in accordance with the present invention, that these and other objects and advantages can be achieved by a stranding process for producing a cable composed of multiple groups of plied filaments wherein the essential steps include:

(a) feeding individual filaments from separate feed positions located on a common extended linear twisting axis for plying into at least two different groups of filaments;

(b) plying and twisting at least one of said groups of filaments by the double-twist principle wherein the individual filaments are first plied together from separate feed positions in a forward take-off direction on or along the twisting axis and are then deflected outwardly and returned backwardly in a rotating pattern around the separate feed positions; and (c) twisting all of said groups of filaments by the cable-twist principle wherein each group of filaments is directed axially in said backward direction beyond the feed positions to be joined in a common twisting zone for plying and twisting together into said cable.

The process of the invention can be carried out such that all of the groups of filaments are first double-twisted and thereafter cable-twisted. In an especially preferred embodiment, however, at least one group of filaments is first plied and double-twisted and is then joined in the common twisting zone for cable-twisting with at least one other group of filaments directed backwardly into said common twisting zone without being double-twisted.

Suitable apparatus for producing the cable by a combined double-twist twisting and a cable-twisting in one operation includes: a plurality of feed spools to supply individual filaments, each of said spools being rockingly mounted on cradle means at spaced positions along a twisting axis which extends longitudinally of the apparatus; rotor means in axial alignment with said twisting axis for synchronous rotation with reference to each of said feed spools; first guide means including at least some guide elements fixed to said rotor means to direct separate groups of filaments backwardly in a rotating pattern around the feed spools; second guide means to direct at least one of said separate groups of filaments for plying in a forward take-off direction from the corresponding group of feed spools together with deflecting means to then direct the resulting plied filaments outwardly and backwardly into said rotating pattern for double-twist twisting; and cable-twisting means at the rear outlet end of the apparatus to receive the backwardly directed separate groups of filaments for twisting into a cable.

Several preferred embodiments of the process and apparatus of the invention are illustrated by way of example by the following detailed description taken in conjunction with the accompanying drawings in which.

Figure 1:
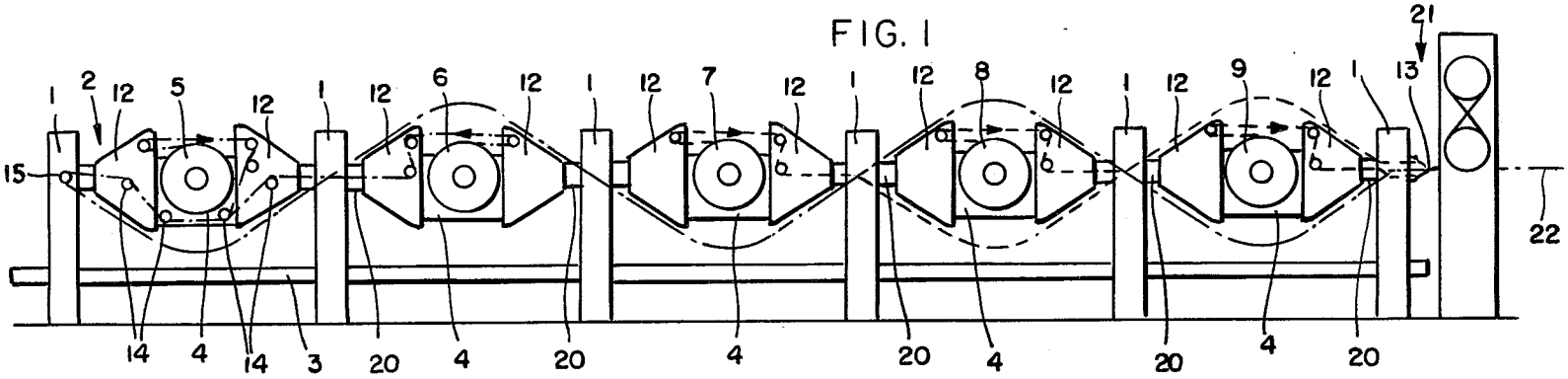
FIG. 1 is a partly schematic side elevational view of a stranding and cable-twisting machine with individual rotors on either side of each feed position.
Figure 2:
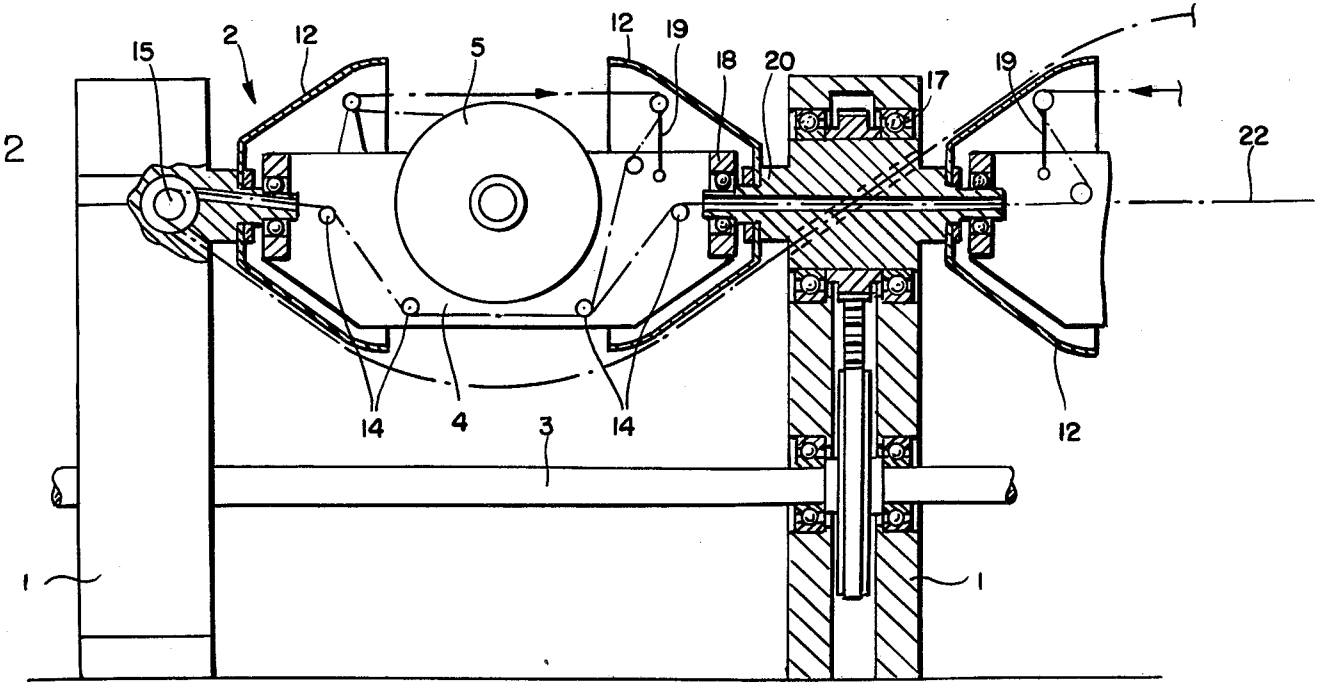
FIG. 2 is an enlarged view, partly in cross-section, of the left or forward end of the machine shown in FIG. 1.
Figure 4B:
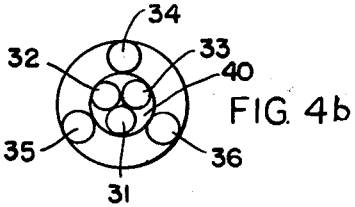
Figure 4A:
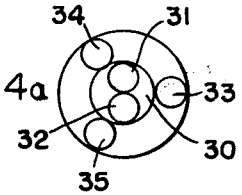
Figure 5:
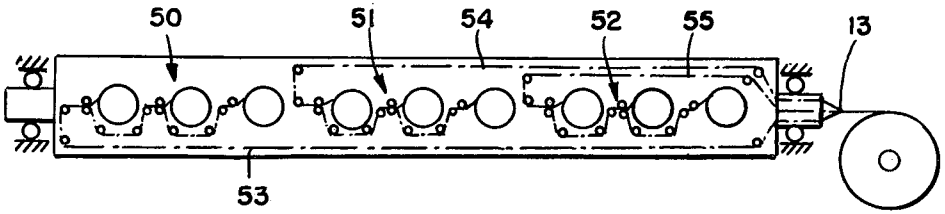
Figure 6:
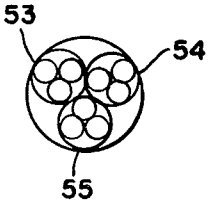

FIGS. 4*a* and 4*b* are transverse cross-sections of cables produced on the two machines of FIGS. 1 and 2, respectively;

FIG. 5 illustrates still another stranding and cable-twisting machine using a rotary drum type of construction; and FIG. 6 is a transverse cross-section of a cable produced on the machine of FIG. 5.

In the following description and for purposes of the present invention, the terms "filament" or "filaments" are to be understood as the individual filament or thread which is delivered from each feed spool and although a monofilamentary metallic wire is most commonly used as each initial feed wire, it is also possible to use multifilament wires or threads of metallic or non-metallic materials. The terms "strand" or "strands" will generally be understood as referring to two or more "filaments" which have been twisted together but may also be used to refer to a single filament, e.g., as sometimes used as a core strand, or to the multifilament strands as obtained by plying two or more "filaments" without imparting any substantial twist thereto. The term "cable" is employed herein to refer to the product obtained by joining a number of groups of twisted filaments or strands into a strong, coherent, entwined product in which two or more "strands" are twisted together, preferably to provide a core-mantle structure in which there is at least one strand or group of double-twisted filaments. The terms "double-twist" and "cable-twist" as applied to the particular methods of joining two or more filaments or strands into a cable are well known in this art and do not require further elaboration.

Taking into consideration these initial statements of the invention and the accompanying drawings, the invention is described hereinafter in detail based upon the specific illustrated embodiments. It will be understood that the process of the invention is not limited to the specific designs of the illustrated apparatus but may be carried out with various different stranding machines when combined to meet the requirements of the invention.

One embodiment of a twisting or stranding apparatus, which is especially useful in carrying out the process of the invention, is shown in FIGS. 1 and 2 and corresponds closely in its design features and mechanical structure to the twisting machines set forth in U.S. Pat. Nos. 4,002,015 and 3,992,867. Attention is therefore directed to these prior patents for an even more detailed discussion of construction and operation.

Conventional machine supports or bearing assemblies 1 are used to rotatably mount the individual rotors 2 on the ball bearings 17. Each rotor 2 consists of a tubular bearing body or roller 20 and two discs or so-called guide pots 12. Even at a relatively low rotational speed of the twisting machine, these guide pots 12 serve the purpose of allowing a wire, which is guided over the curved surfaces of the pots, to be drawn outwardly around each spool carrier 4 arranged between the open ends of two opposing pots and also around the feed spool 5, 6, 7, 8 or 9 held in a rocking or cradled position on each spool carrier 4. At the same time, the guide pots 12 also direct the transported wire or strand (shown in broken line form) for rotation in a sinusoidal balloon pattern about the rotor axis and the common cable-twisting axis 22.

The rotors 2 are driven through suitable gearing means by the drive shaft 3 which in turn is motor driven, substantially in the same manner as the twisting machine illustrated and described in U.S. Pat. No. 3,981,131. During operation, these rotors 2 are run at a constant rotational speed, and all of the rotors run at the same speed off of the drive shaft 3. The individual spool carriers 4 are doubly supported or pivotally mounted to swing in cradled manner on the ball bearings 18 borne on the oppositely facing tubular body members 20 of each rotor 2 extending along the twist axis 22 and being located within the oppositely facing open ends of the guide pots 12. As shown in greater detail in FIG. 2, the first machine support 1 at the front end of the machine does not require a rotor but still has a tubular bearing member to carry the ball bearings 18 on the left-hand side of first spool carrier 4 which holds the first feed spool 5. Each succeeding spool carrier from left to right or front to rear of the machine holds the correspondingly succeeding feed spools 6, 7, 8 and 9, respectively. Each feed spool is mounted for rotation on its carrier 4 with the spool axis being located transversely of the twist axis 22, the center of gravity of the carrier 4 and its feed spool falling below the twist axis 22 to help stabilize the carrier assembly against excessive swinging or rocking movement. The feed spools can be braked or decelerated by means of the dancer arm 19 and a brake means as also described in the above-noted U.S. Pat. No. 3,981,131 and in further detail in the German published patent specification (DOS) No. 1,808,120. A number of rotatable guide rollers such as 14 are mounted on shafts or pins which in turn are easily fastened to side walls of the carrier 4 or on a bracket arm as shown for the feed guide roll positioned to the left of the feed spool 5 on top of carrier 4 in FIG. 2.

In the embodiment of FIGS. 1 and 2, the first two feed spools 5 and 6 at the front end of the machine are arranged with guide rollers or deflecting means to provide a double-twist effect with the help of the internal guide roller 15 contained within the first rotor 2 and mounted therein for free rotation on a transverse axis or shaft which is fixed to the rotor so that the roller 15 will rotate end for end in a plane transverse to the twist axis 22. The last three feed spools 7,8 and 9 are arranged at the rear part of the machine with a different set of deflecting means adapted to conduct the individual wires or strands from their respective feed spools directly into a cable-twist operation at the cable-twist point 13 located at the exit or rear end 21 of the machine.

The last rotor 20 to the right of feed spool 9 has a shaft or stub extension protruding to the rear of the support 1 with guide conduits or passageways such that a core wire is drawn from the final rotor along the longitudinal twist axis 22 while the mantle wires are drawn off at positions spaced radially outwardly from the core wire, preferably at diametrically opposite positions of a common circle. The individual wires or strands brought together at the twist point 13 are thus cable-twisted into a core/mantle type of cable structure. Other similar cable-twisting arrangements may also be used although a simple twisting stub or head in the last rotor is especially preferred.

Following the exit 21 of the machine, any number of known and conventional cable treating devices can be added such as the schematically illustrated roller pair arranged vertically one over the other in FIG. 1. Such devices are commonly employed, e.g., as a means of aligning or straightening the cable to provide a more even and uniform cable product. In general, the cable is drawn off by means of draw-off reels or winding spools (not shown in FIGS. 1 or 2).

For purposes of the present invention, it should be noted here that the feed spools may contain filaments, wires, strands, threads or any other filamentary material suitable for twisting into a cable.

The procedure of forming a so-called core/mantle or a core/sheath cable can be explained as follows with reference to FIGS. 1 and 2, for example to produce the cable shown in cross-section in FIG. 4*a*. As noted above, the elongated feed spool and rotor assembly of the twisting machine is divided into two distinct sections, i.e., a double-twist section represented by the feed spools 5 and 6 on the one hand and a single-twist section represented by the feed spools 7, 8 and 9 on the other hand. These last three feed spools are rockingly mounted adjacent one another on their respective carriers 4 along the twist axis 22 so as to be located at the rear or exit end 21 of the machine. The first two feed spools 5 and 6, used for double twisting, are located at the opposite front end of the machine. The filaments or wires being drawn off of the spools 7, 8 and 9 are guided to the twist point 13 in the same manner as shown and described in U.S. Pat. No. 4,002,015, i.e., these three wires are guided from the spools by individual guide rollers on the carrier 4 for transport first to the tubular part of the rotor 20 where the wire can be initially drawn off along the twist axis. As the wire passes through this first rotor following the feed spool, it is then deflected outwardly by suitable guide openings, bores or passages in the rotor so as to be directed in a rotating sinusoidal balloon pattern around each successive feed spool and carrier, crossing at the twist axis through the next rotor until collected at the final rotor for cable-twisting. As shown in FIG. 1, the three wires from the feed spools are brought into the last rotor 20 adjacent the twist point 13 at radially spaced positions around the twist axis 22 so that each of these individual single-twist wires are applied around a core wire or strand projecting from this last rotor 20 to the twist point 13. Thus, the wires from feed spools 7, 8 and 9 are conducted in the balloon pattern and rotated around the twist axis by the last rotor as they are applied to the core at twist point 13. In this process, the resulting mantle or sheath wires receive a single twist for each revolution of the machine.

By comparison, the two wires being drawn off from the first two feed spools 5 and 6 are plied together on or along the twist axis 22 as they are directed forwardly to the front end of the machine for deflection at point 15, using a suitable rotating deflection roller, and are only then directed backwardly in the rotating sinusoidal balloon pattern around each individual feed spool position. This procedure is essentially the same as that described in U.S. Pat. No. 3,992,867 to provide the desired double-twist effect. In the twisting machine shown by FIGS. 1 and 2 herein, the feed spools and each carrier 4 is located directly on the twist axis 22, so that it is necessary to provide the guide means 14 as a deflecting arrangement to conduct the individual wires or plied strands around each feed spool along the twist axis at the front end of the machine. Accordingly, while the wire from spool 6 is first drawn off over the upper guide rolls such as that on dancer arm 19 and then directly down to the twist axis 22, it is necessary to draw off this wire from spool 6 as it is plied with the wire from spool 5 so as to be deflected around the spool 5 in the forward take-off direction by means of additional guide rollers 14. The plied wires are then guided slantingly up to the deflection roller 15 on the twist axis.

The complete two-ply strand from spools 5 and 6 is intended in this example based on FIGS. 1 and 2 as the core strand around which the remaining wires or strands from spools 7, 8 and 9 are to be twisted as the sheath. As the forwardly directed two-ply strand is deflected outwardly and then backwardly around the front deflection roller 15, it receives a first twist and is conducted backwardly along the twist axis in a sinusoidal rotating ballon pattern or path as indicated so as to pass around each feed spool position until finally brought into the twist point 13 at the machine exit 21. In this instance, the two-ply strand is guided through the final rotor as a twisting head directly on the twist axis 22 so as to be properly positioned as a core strand. A second twist is thereby imparted to the core strand during each revolution of the machine following the first twist imparted at the front end of the machine. In the illustrated embodiment, it will therefore be apparent that one can achieve a double-twisted core strand surrounded by a single twisted set of sheath or mantle strands, all in one operation on the single twisting machine.

It may be mentioned here that it is not theoretically or absolutely essential for the feed spools for the sheath wires being subjected to a single twist to be located directly adjacent to the feed spools for the core wires being double-twisted and also the feed spools for the sheath wires need not be closest to the rear or exit end of the machine. For practical reasons, however, the relationship of the two sets of feed spools illustrated herein is the most logical and expedient in terms of process technology, in order to avoid unnecessary wire tension and unnecessary costs in the structural arrangement and assembly of the complete machine. Therefore, while refinements can be made in the structural features adopted for a combined double-twist and single cable-twist on one machine, the particular arrangements disclosed herein are the most preferred. It should also be noted and again emphasized that all of the rotors have the same rate of rotation, preferably as operated by a single drive shaft or other drive means.

At the machine exit 21 in FIG. 1, the wire cable is formed with a two-ply core strand and three sheath wires or strands wherein the core strand has twice as many turns as the sheath strands and one-half the twist length of the sheath strands.

In FIG. 4*a* there is shown in cross-section one example of a cable as produced by the machine of FIG. 1. It consists of the core strand 30 made up of two plied wires or strands 31 and 32 as taken off from the feed spools 5 and 6, respectively, and guided through the machine so that a double twist is imparted thereto in each machine revolution. The remaining three wires or strands 33, 34 and 35 are drawn off from the feed spools 7, 8 and 9, respectively, and twisted or wrapped around the core strand with a single twist per machine revolution according to the cable-twist principle, thereby providing a mantle or sheath composed of three wires or strands around the twisted core strand 30.

Figure 3:
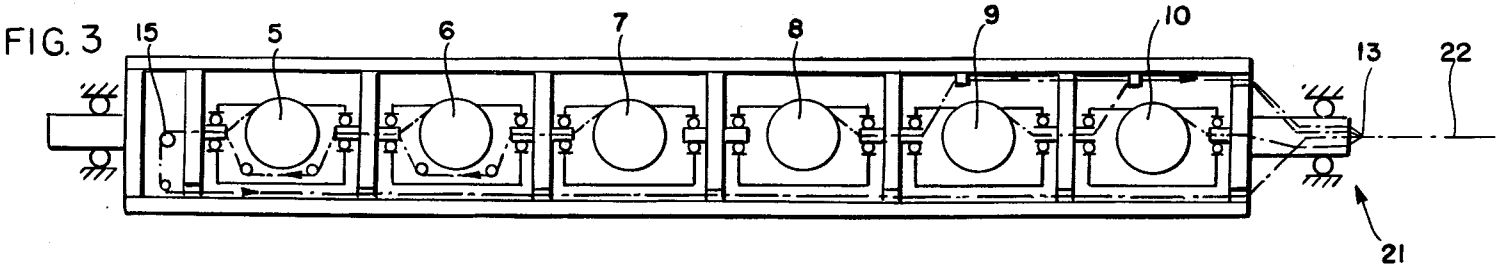
FIG. 3 is a partly schematic side elevational view of another stranding and cable-twisting machine of the rotary drum type, as adapted for purposes of the present invention.

The stranding and twisting machine of FIG. 3 is different in its construction and arrangement from the embodiment shown in FIGS. 1 and 2 in that all of the feed spools 5, 6, 7, 8, 9 and 10 are arranged within a common drum rotor which can be motor driven as a single rotating cylindrical housing by conventional means. In this case, the six feed spools are mounted on individual spool carriers which in turn are supported on pivots or rotatable bearing supports located concentrically around the rotor axis or twist axis 22. See, for example, the more detailed discussion and illustration of a drum rotor in U.S. Pat. No. 3,636,692, especially in column 3, lines 45–65. It is also to be observed that other drum rotors may be used, e.g., twisting machines with two or more drums which are synchonously rotated or driven even if separately mounted for individual rotation. In this case, the double-twisted (core) wires or strands can be taken off from one drum and combined at a common twist point with the single-twisted (sheath) wires or strands taken off from another drum.

The transport and guidance of the wires or strands in the drum rotor of FIG. 3 is similar to that required in the disc or pot type rotor of FIG. 1. The primary difference arises due to the drum type of construction which prevents the wires or strands in their return path or backward conduction around the feed spools from being set up in a sinusoidal balloon path. In this rotary drum arrangement, by contrast, the singly-twisted wires from the back three spools are immediately plied together in a deflected path running parallel along the drum wall for two of these wires and in an axial path for the wire drawn off the last spool 10, the plying taking place at the twist point 13 or partially along the drum walls as the wires from the spools 8 and 9 may be joined without twisting. However, as indicated in FIG. 3, the cable-twisted wires with a single twist will usually be conducted separately to the twist point to form the sheath around a core wire or strand. The front three feed spools 5, 6 and 7 are shown in this embodiment as providing wires or strands to be plied on or along the twist axis in a forward direction up to the deflection point 15 where they are turned outwardly and then backwardly along the drum wall, i.e., its inner circumferential surface, so as to run axially longitudinally to the rear end of the machine to be joined as the core strand at the cable-twisting point 13. The rotor head at the machine exit 21 is in this case provided with suitable bores or guide passageways to conduct the double-twisted core strand on the twist axis 22 while the separate singly-twisted sheath strands are wrapped therearound. Again, the bores for the sheath strands are preferably located radially equidistant at symmetrical positions around the twist axis in the rotor head at 21.

In FIG. 4*b* there is shown in cross-section an example of the cable which can be produced with the machine of FIG. 3. Here, the core strand 40 consists of three wires 31, 32 and 33 produced by the double-twist principle as they are drawn off forwardly from the feed spools 5, 6 and 7, deflected by the front guide roller assembly and returned backwardly along the drum wall to the twist point 13. The sheath or mantle wires 34, 35 and 36 wound about the core strand 40 are those drawn off from the feed spools 8, 9 and 10, respectively, and conducted backwardly with a single twist being introduced according to the cable-twist principle as they are applied to the core strand 40 at the twist point 13.

Still another design of a rotary twisting machine of the drum rotor type is set forth in FIG. 5 for producing a cable in accordance with the process or method of this invention. In general, the drum construction and rocker mounted feed spools or reels are the same as in FIG. 3, but in this case there are provided three different groups of feed spools, each with three spools for first plying and then twisting the individual wires or strands. In this instance, each group of feed spools 50, 51 and 52 is operated to take off and double twist all of the wires or strands in each group, so that in this illustrated example, the plied and double-twisted strands are represented by the broken line paths 53, 54 and 55 which run backwardly along the drum wall from their respective deflection points or deflecting roll assemblies at the front end of each group of spools. Each of the plied strands receives a first twist at its own deflection point and is then twisted a second time in each revolution of the machine as the strands are passed through the twisting head at the rear or exit end of the machine to be twisted together at the cable-twist point 13. The cable product is shown in this case as being immediately wound onto a take-up reel following the twist point 13, although it is again feasible to subject the cable to conventional aligning or finishing steps.

The cable product produced on this last mentioned machine is represented by way of example in FIG. 6. In contrast to the cable products produced on the earlier mentioned machines, the mantle or sheath strands are all produced by the cable-twisting process from the three plied strands 53, 54 and 55 as produced by the so-called double-twist twisting process. In fact, a core strand is not always required if the double-twisted strands are directed through the final cable-twisting operation as shown to be twisted with each other in a symmetrical manner directly about the twist axis.

Once again it should be pointed out that it is not absolutely necessary for purposes of the present invention to use strands of a particular kind as the material supplied from the individual feed spools. One may use monofilaments or individual wires as well as multifilament wires, threads, strings, cords, strands or the like for twisting into the cable according to the combination of process steps of the invention or the apparatus used for this process.

It is a particular advantage of the present invention not only that the cable is produced in a single stranding or plying and twisting operation, preferably on a single or commonly driven twisting machine, but also that the cable can be produced with different amounts of twist imparted to selected groups of wires or strands in order to provide structural variations in the cable with greater flexibility in cable design without requiring separate drawing, plying and twisting operations. At the same time, the process and apparatus of the invention combine both double-twisting and also cable-twisting into a single operation while making use of those processes and apparatus which are already generally known and which can be adapted to use for the present invention with minimal changes in structure and operation. The invention is especially useful for producing core/sheath cables wherein the core is made up of the double-twisted strands while the mantle or sheath is made up of a plurality of singly-twisted strands. On the other hand, the invention also permits the sheath strands to be double-twisted about a core strand which may be a single wire, filament or the like or else a singly or double twisted strand of plied wires, filaments or the like. Moreover, double-twisted strands can be cable-twisted in the process without a core strand to provide a uniformly twisted set of double-twisted strands about the twist or cable axis. The single twisting operation substantially reduces costs as well as reducing space requirements and total production time.

The invention is hereby claimed as follows:

1. A stranding process for the production of a cable composed of multiple groups of plied filaments, which process comprises the steps of:

feeding individual filaments from separate feed positions located on a common extended linear twisting axis for plying into at least two different groups of filaments, at least two feed positions being provided for each group;

plying and twisting at least one of said groups of filaments by the double-twist principle wherein the individual filaments are first plied together from separate feed positions in a forward take-off direction on or along the twisting axis and are then deflected outwardly and returned backwardly in a rotating pattern around the separate feed positions; and twisting all of said groups of filaments by the cable-twist principle wherein each group of filaments is directed axially in said backward direction beyond the feed positions to be joined in a common twisting zone for plying and twisting together into said cable.

2. A process as claimed in claim 1 wherein all of the groups of filaments are first double-twisted and are thereafter cable-twisted.

3. A process as claimed in claim 1 wherein at least one group of filaments is first plied and double-twisted and is then joined in said common twisting zone for cable-twisting with at least one other group of filaments directed backwardly into said common twisting zone without being double-twisted.

4. Apparatus for plying and stranding multiple groups of filaments into a cable by double-twist twisting and by cable-twisting in one operation, which apparatus comprises:

a plurality of feed spools to supply individual filaments, each of said spools being rockingly mounted on cradle means at spaced positions along a twisting axis which extends longitudinally of the apparatus;

rotor means in axial alignment with said twisting axis for synchronous rotation with reference to each of said feed spools;

first guide means including at least some guide elements fixed to said rotor means to direct at least two separate groups of filaments from corresponding groups of feed spools backwardly in a rotating pattern around the feed spools;

second guide means to direct at least one of said separate groups of filaments for plying in a forward take-off direction from the corresponding group of feed spools together with deflecting means to then direct the resulting plied filaments outwardly and backwardly into said rotating pattern for double-twist twisting; and cable-twisting means at the rear outlet end of the apparatus to receive the backwardly directed separate groups of filaments for twisting into a cable.

* * * * *